US006318447B1

(12) United States Patent
Sheldon

(10) Patent No.: US 6,318,447 B1
(45) Date of Patent: Nov. 20, 2001

(54) SAND GATE FOR USE IN A SAND DISTRIBUTION APPARATUS

(76) Inventor: David Samuel Sheldon, P.O. 307, Helena, AL (US) 35080

( * ) Notice: Subject to any disclaimer, the term of this patent is extended or adjusted under 35 U.S.C. 154(b) by 0 days.

(21) Appl. No.: 09/544,585

(22) Filed: Apr. 6, 2000

(51) Int. Cl.[7] ..... B22C 5/12
(52) U.S. Cl. ..... 164/192; 222/502
(58) Field of Search ..... 164/192, 193, 164/194; 222/502, 503

(56) References Cited

U.S. PATENT DOCUMENTS 4,593,739 * 6/1986 VanRens et al. ..... 164/192
4,600,046 * 7/1986 Bailey et al. ..... 164/192
6,179,171 * 1/2001 Ferguson et al. ..... 164/192

* cited by examiner

*Primary Examiner*—Nam Nguyen
*Assistant Examiner*—I.-H. Lin
(74) *Attorney, Agent, or Firm*—Robert J. Veal; Christopher A. Holland; Burr & Forman LLP

(57) ABSTRACT

An apparatus for promoting desired sand distribution into a mold flask in a foundry process, comprising a proximal distribution plate mounted subjacent a hopper, a distal distribution plate slidably mounted subjacent the proximal distribution plate, and a masking plate assembly mounted subjacent to the distal distribution plate. The proximal distribution plate includes a series of primary apertures, while the distal distribution plate includes a series of repeating secondary apertures therethrough, with each series of secondary apertures corresponding to one primary aperture. The masking plate assembly includes a masking plate having a series of masking plate bores traversing therethrough, with each masking plate bore corresponding to each secondary aperture. Each masking plate bore includes a principal diameter extending through the masking plate, with the principal diameter determining the flow rate of sand through the masking plate.

26 Claims, 10 Drawing Sheets

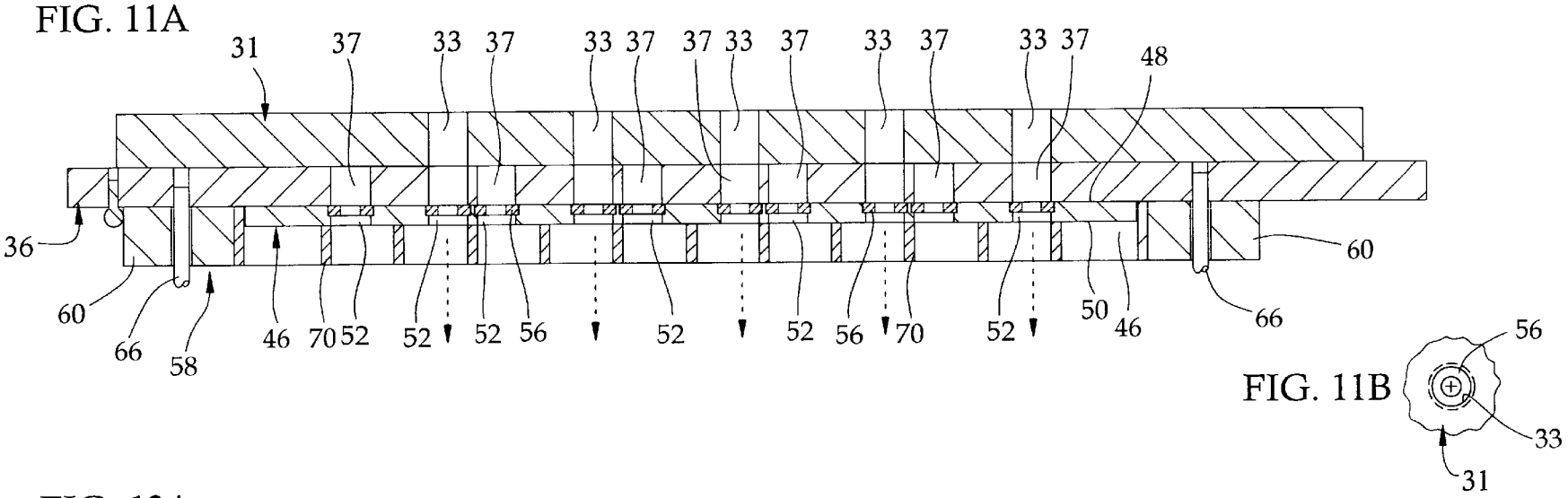
FIG. 11A
FIG. 11B
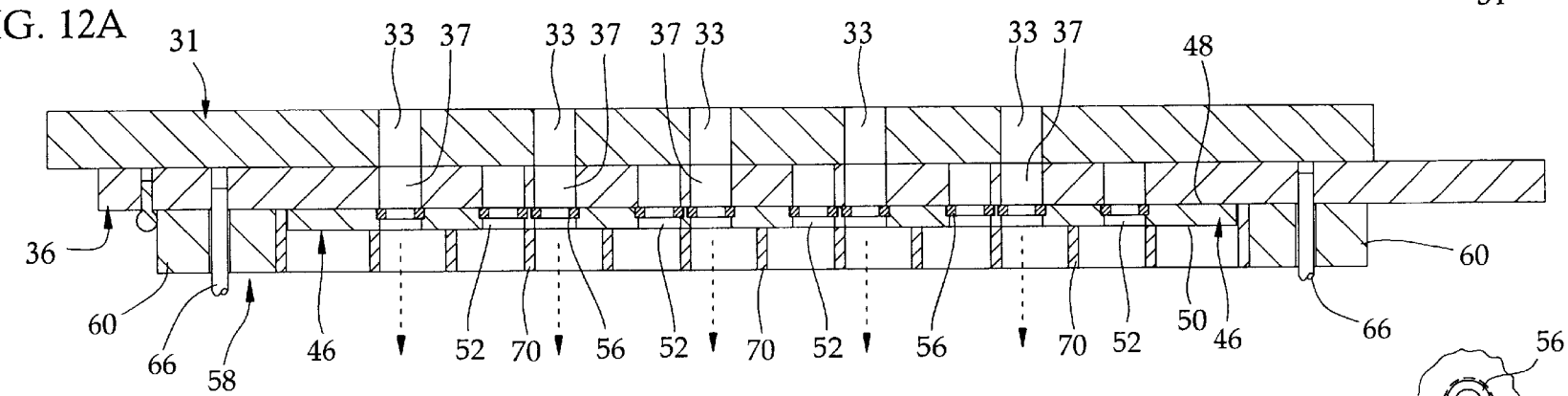
FIG. 12A
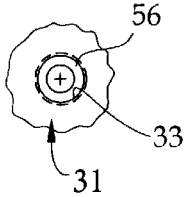
FIG. 12B

FIG. 13A
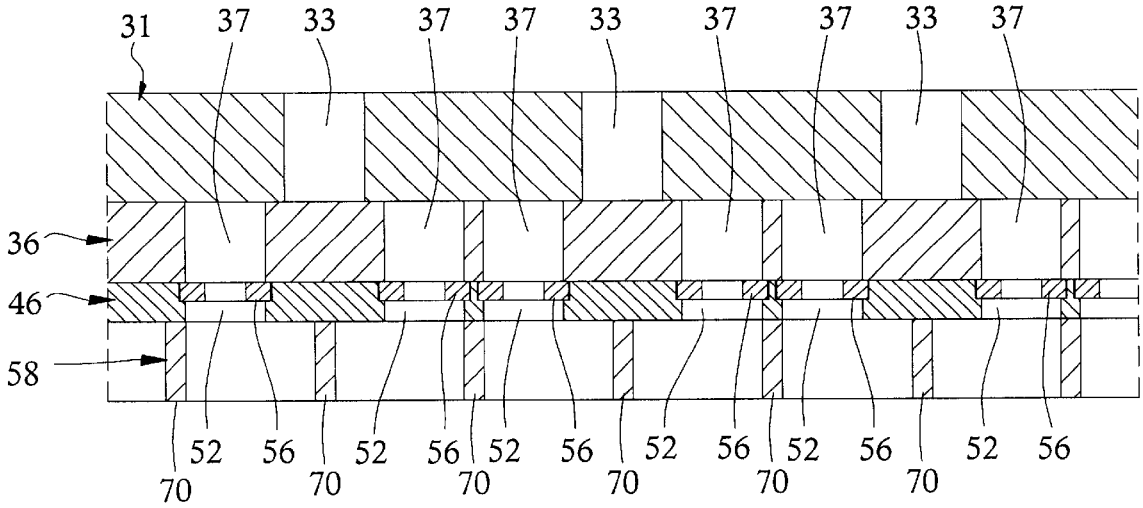
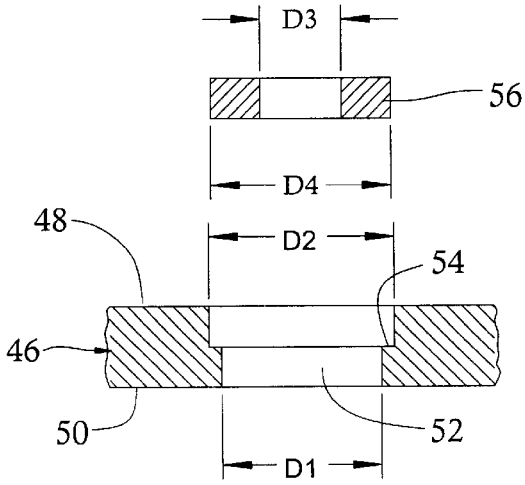
FIG. 13B

SAND GATE FOR USE IN A SAND DISTRIBUTION APPARATUS

FIELD OF THE INVENTION

The present invention relates to an apparatus for use in a foundry operation. More particularly, the present invention relates to an apparatus for controlling the distribution of sand into a mold flask in a casting process, such as a lost foam casting process.

BACKGROUND OF THE INVENTION

In a typical lost foam casting process, a foam mold pattern is placed within a mold flask, wherein the foam pattern includes a foam riser that extends from the foam pattern towards the top of the flask. Sand from a hopper located above the flask is poured into the flask around the foam pattern. As the sand fills the flask, the sand becomes compacted about the foam pattern. After the flask has been adequately filled with sand, which preferably corresponds to a level equal to the top of the riser, molten metal is poured onto the riser to engage the foam pattern, and the molten metal vaporizes the foam riser and pattern. Thus, the molten metal replaces the foam pattern. The metal is cooled until the casting is solidified, at which time the casting and sand are removed from the flask.

A problem that has been encountered in the industry is that if sand is not uniformly distributed about the foam pattern during the sand filling process, the foam pattern is subjected to uneven weight distribution from the sand which can damage or distort the foam pattern, potentially resulting in an inferior or unusable casting. As a result, there have been various improvements in sand distribution assemblies to address this problem, with the solutions having been implemented with varying degrees of success.

One improvement is the use of sand distribution plates to promote uniform distribution of sand in the flask, wherein a first distribution plate ("fixed plate") having a plurality of apertures therethrough is affixed to the bottom of the hopper and a second distribution plate ("slide plate") having a plurality of apertures therethrough, corresponding to the apertures through the proximal distribution plate, is slidably mounted subjacent the proximal distribution plate such that the distal distribution plate is movable between a closed position, wherein the apertures in the first and distal distribution plates do not overlap, and an open position, wherein the apertures in the first and distal distribution plates overlap such that multiple streams of sand "rain" into the flask. The apertures through the plates can be fully overlapped for maximum sand flow, or they can be partially overlapped to infinitely variable degrees for reduced sand flow. This is an important feature because when sand is initially poured into the flask, the flow rate should be reduced so that the sand will not damage the foam pattern and so that the sand will have an adequate time to fill any cavities in the foam pattern. As the sand level rises above the top of the foam pattern, the apertures through the distribution plates are preferably fully overlapped for maximum sand flow to quickly fill the remainder of the flask, thereby maximizing production efficiency.

While use of the sand distribution plates, collectively known in the art as a "rain gate" or "sand gate", has substantially improved uniform sand distribution in the flask, other problems have arisen. First, when the apertures in the distribution plates are partially overlapped, the sand flow therethrough is skewed such that the sand tends to accumulate towards one side of the flask rather than uniformly therein. Additionally, the sand is offset from the center of the apertures through the fixed plate, thereby shifting the predetermined streams of sand such that the sand tends to accumulate towards one side of the flask rather than uniformly therein. The non-uniform sand accumulation results in uneven weight distribution about the foam pattern, which can damage or distort the foam pattern, potentially resulting in an inferior or unusable casting.

Accordingly, what is needed is an improved sand gate design to promote uniform sand distribution in a mold flask that overcomes the problems in the prior art.

SUMMARY OF THE INVENTION

It is an object of the present invention to provide an apparatus for controlling the distribution of sand into a mold flask in a casting process.

It is another object of the present invention to provide a sand distribution apparatus for controlling the distribution of sand into a mold flask at different rates of sand flow.

It is another object of the present invention to provide a sand distribution apparatus having one fixed distribution plate and one slide distribution plate with a masking plate attached to the slide distribution plate to provide multiple patterns for distributing sand into a mold flask.

It is another object of the present invention to provide a sand distribution apparatus that produces substantially vertical streams of sand at any designated flow rate to promote uniform sand distribution within the mold flask.

It is another object of the present invention to provide a sand distribution apparatus that substantially reduces or eliminates skewing of flowing sand during reduced flow rates to promote uniform sand distribution within the mold flask.

It is another object of the present invention to provide a sand distribution apparatus that substantially eliminates offset of flowing sand from the center of the apertures through the fixed plate during reduced flow rates to promote uniform sand distribution within the mold flask.

These and other objects of the present invention are accomplished through the use of an improved sand gate in a sand distribution apparatus for promoting desired sand distribution into a mold flask in a casting process, such as a lost foam casting process. The sand distribution apparatus comprises a proximal fixed plate mounted subjacent a hopper, wherein the proximal fixed plate has a plurality of uniform primary apertures therethrough through which sand flows from the hopper. The sand distribution apparatus additionally includes a distal distribution plate slidably mounted subjacent the proximal fixed plate, wherein the distal distribution plate has a repeating series of uniform secondary apertures therethrough, with each series of secondary apertures corresponding to one primary aperture. Consequently, the distal distribution plate is movable between a closed position, wherein the primary apertures of the proximal fixed plate and the secondary apertures of the distal distribution plate do not overlap; and a plurality of open positions, wherein the primary apertures through the proximal fixed plate and the distal distribution plate do overlap. Moreover, the sand distribution apparatus includes a set of positive stop locators that ensure the positive location of the distal distribution plate at open positions.

The sand distribution apparatus additionally includes a masking plate assembly that is used in conjunction with the distal distribution plate. The masking plate assembly includes a masking plate and a masking plate holder, with a second embodiment also including a series of ring members. The masking plate assembly is attached subjacent to the distal distribution plate. The masking plate includes a series of masking plate bores that traverse therethrough, with each masking plate bore corresponding to one secondary aperture traversing the distal distribution plate. When the masking plate is connected to the distal distribution plate, each masking plate bore will be positioned in direct alignment with the corresponding secondary aperture. Moreover, each masking plate bore has a principal diameter that extends through the masking plate, with the width of the principal diameter determining the flow rate of sand through the masking plate in this first embodiment.

In a second embodiment, the masking plate bore includes an auxiliary diameter subjacent the top surface of the masking plate. The auxiliary diameter is greater than the principal diameter such that a shoulder is created within the masking plate bore. The ring member of the masking plate assembly has an outer diameter and an inner diameter, with the outer diameter of the ring member designed such that the ring member will fit intimately within the masking plate bore upon the shoulder. As a result, when the primary and secondary apertures are aligned, the sand will be distributed from the hopper through the primary and secondary apertures and then through the ring member and the masking plate bore. Consequently, the inner diameter of the ring member in this embodiment will determine the flow rate of sand through the masking plate rather than the principal diameter of the masking plate bore as in the first embodiment. As a result, any number of ring members having various sized inner diameters may be placed upon the shoulder within the masking plate bore such that the inner diameter of the ring member will determine the flow rate of the sand through the ring member; that is, the greater the size of the inner diameter of the ring member, the greater the rate of flow of sand therethrough.

These and other objects and advantages of the invention will become apparent from the following detailed description of the preferred embodiment of the invention.

BRIEF DESCRIPTION OF THE DRAWINGS

A sand distribution apparatus embodying features of the invention is described in the accompanying drawings which form a portion of this disclosure and wherein:

FIG. 11A is a sectional view of the proximal and distal distribution plates and masking plate assembly of the present invention as illustrated in FIG. 10 in a first opened position;

FIG. 11B is a top plan view of overlapping primary, secondary, and masking plate bores of the sand distribution plates of FIG. 11A;

FIG. 12A is a sectional view of the proximal and distal distribution plates and masking plate assembly of the present invention as illustrated in FIG. 10 in a second opened position;

FIG. 12B is a top plan view of overlapping apertures of the sand distribution plates of FIG. 12A;

FIG. 13A is an sectional view of the arrangement of the proximal distribution plate, the distal distribution plate, and the masking plate assembly; and FIG. 13B is a sectional view of one masking plate bore in the masking plate, with a ring member being shown exploded above the masking plate bore.

DETAILED DESCRIPTION OF THE PREFERRED EMBODIMENT

A more complete understanding of the invention may be obtained by reference to the accompanying drawings wherein the relevant portions of a prior art foundry operation and some of the problems encountered therein are illustrated in FIGS. 1–4, and the illustrative embodiments of the present invention are illustrated in FIGS. 5–14B. Further, while the description herein is particularly directed to a lost foam casting process, the present invention has application in any foundry operation in which sand is distributed into a mold flask.

Figure 1:
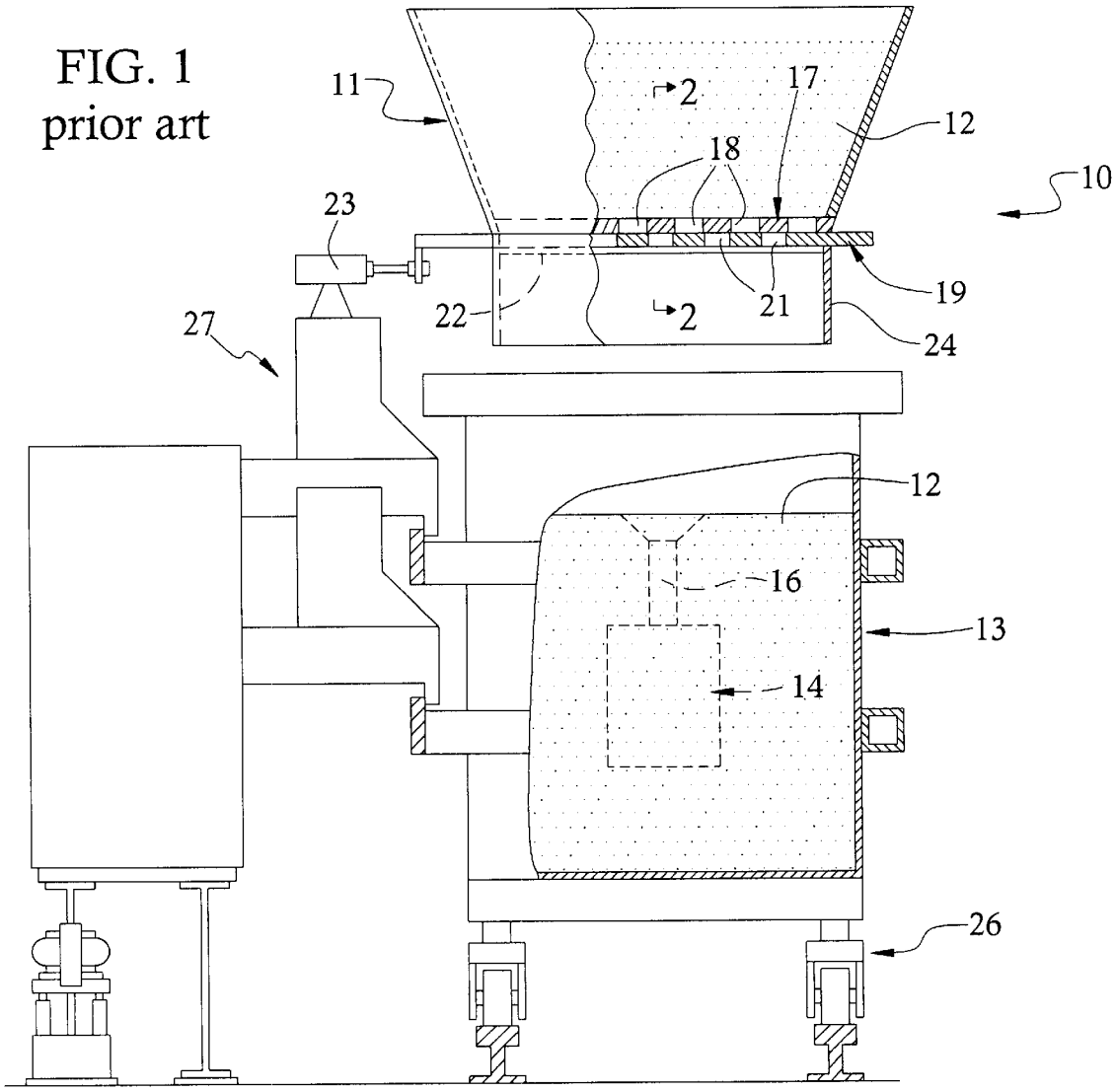
FIG. 1 prior art
FIG. 1 is a side elevational view, partially broken away and in section, of a typical sand filling station in a prior art foundry operation.

FIG. 1 illustrates a sand filling station 10 in a conventional foundry operation, wherein a hopper 11 having a supply of sand 12 therein is suspended over a mold flask 13 having a foam mold pattern 14 therein. The foam pattern 14 includes a foam riser 16 extending from the foam pattern 14 towards the top of the flask 13. A first distribution plate 17 having a plurality of apertures 18 therethrough is affixed to the bottom of the hopper 11 and a second distribution plate 19 having a plurality of apertures 21 therethrough, corresponding to the number and placement of the apertures 18 through the first distribution plate 17, is slidably mounted subjacent the second distribution plate 19 such that the second distribution plate 19 is movable between a closed position, wherein the apertures 18, 21 through the first and second distribution plates 17, 19 do not overlap (see FIG. 1), and an open position, wherein the apertures 18, 21 through the first and second distribution plates 17, 19 overlap such that multiple streams of sand can flow through the first and second distribution plates 17, 19 into o the flask 13 (see FIG. 3A).

Figure 2:
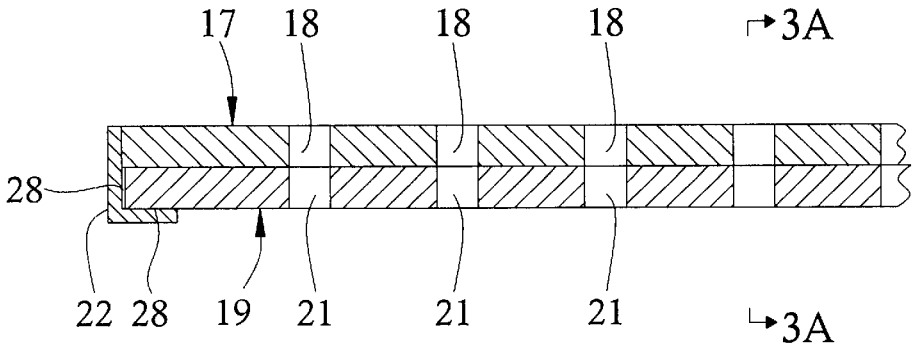
FIG. 2 prior art
FIG. 2 is a sectional view of the sand distribution plates taken along line 2—2 of FIG. 1.

Continuing to look at FIGS. 1 and 2, the second distribution plate 19, or "slide plate", is supported by a pair of opposing elongated L-brackets 22 mounted to the first distribution plate 17 through which the second distribution plate 19 is longitudinally driven by driving means 23, such as hydraulic cylinders. A guide jacket 24 is preferably suspended below the first and second distribution plates 17, 19 to direct sand from the periphery of the first and second distribution plates 17, 19 into the flask 13. The flask 13 is supported on conveying means 26, which carry the flask 13 into and out of the sand filling station 10. The sand filling station 10 preferably includes a vibrating apparatus 27 which vibrates the flask 13 during the sand filling process to promote proper distribution and compaction of the sand about the foam pattern 14 and into any cavities or crevices therein. The equipment and methods used for vibrating mold flasks are well known in the foundry art (for example, see U.S. Pat. No. 4,600,046 to Bailey and U.S. Pat. No. 4,593,739 to Van Rens) and will not be set forth herein.

Figure 3A:
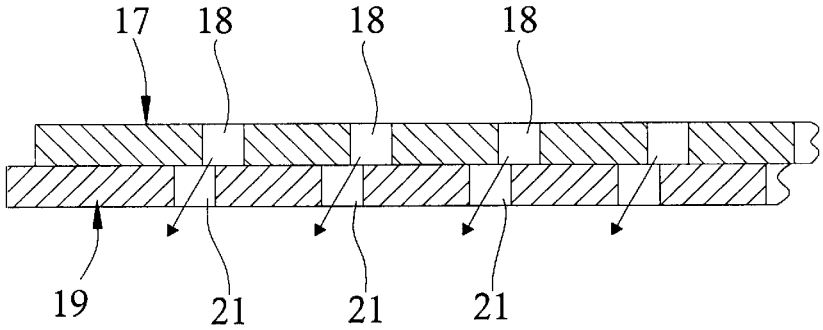
FIG. 3A prior art
FIG. 3A is a sectional view of the sand distribution plates taken along line 3A—3A of FIG. 2, with the apertures being slightly out of line.
Figure 3B:
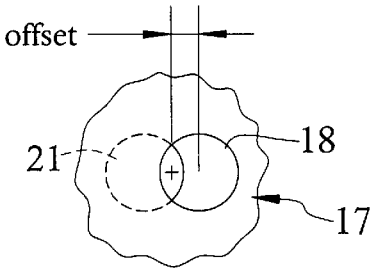
FIG. 3B prior art
FIG. 3B is a top plan view of overlapping apertures of the sand distribution plates of FIG. 3A.
Figure 4:
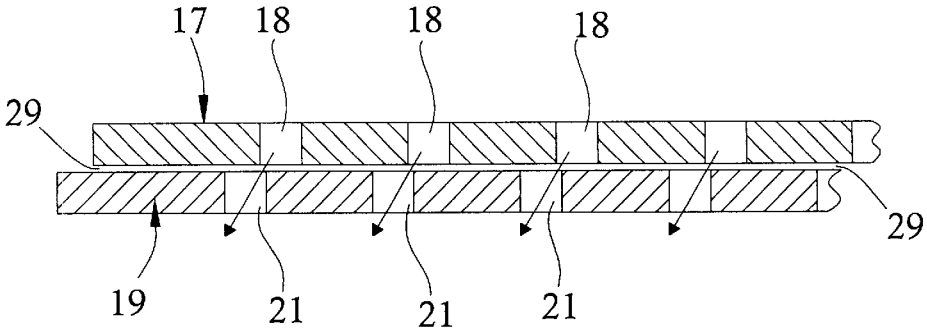
FIG. 4 prior art
FIG. 4 is a sectional view, equivalent to the view of FIG. 3A, of sand distribution plates having a gap formed therebetween.

FIGS. 1 and 3 illustrate the positioning of the prior art sand distribution plates 17, 19. FIG. 1 illustrates the closed position of the sand gate in which the apertures 18 of the first plate 17 do not overlap with the apertures 21 of the second plate 19. FIG. 3A illustrates the skewed sand flow encountered with prior art distribution plates 17, 19 that are in a partially open position, which results in accumulation of sand towards one side of the flask 13 rather than uniformly therein. FIG. 3B further illustrates the offset of sand flow from the center of the apertures through the fixed plate encountered with prior art distribution plates 17, 19 in a partially open position, which shifts the predetermined streams of sand such that the sand tends to accumulate towards one side of the flask 13 rather than uniformly therein. FIG. 4 illustrates gaps 29 between the distribution plates 17, 19, which can result from sand erosion or improper alignment of the distribution plates 17, 19. Sand erosion occurs when sand penetrates the space 29 between the plates 17, 19 and migrates to the edges of the distribution plates 17, 19 and accumulates between the second distribution plate 19 and the L-bracket 22, wherein the areas of sand accumulation are designated at positions 28 in FIG. 2. As the second distribution plate 19 is slid between the opened and closed position, abrasion from the sand will slowly erode the abutting surfaces of the first and second distribution plates 17, 19 and the abutting surfaces of the slide plate 19 and the L-bracket 22 until gaps 29 form between the first and second distribution plates 17, 19, resulting in greater sand accumulation between the distribution plates 17, 19 and between the second distribution plate 19 and the L-bracket 22, thereby increasing the erosion, increased skewed and offset sand flow during the reduced sand flow portion of the filling cycle, and greater sand flow than predicted at any particular overlapped position during the reduced sand flow portion of the filling cycle. Although illustrated as uniform and contiguous in FIG. 4, the gaps 29 typically develop from non-uniform erosion.

Figure 5:
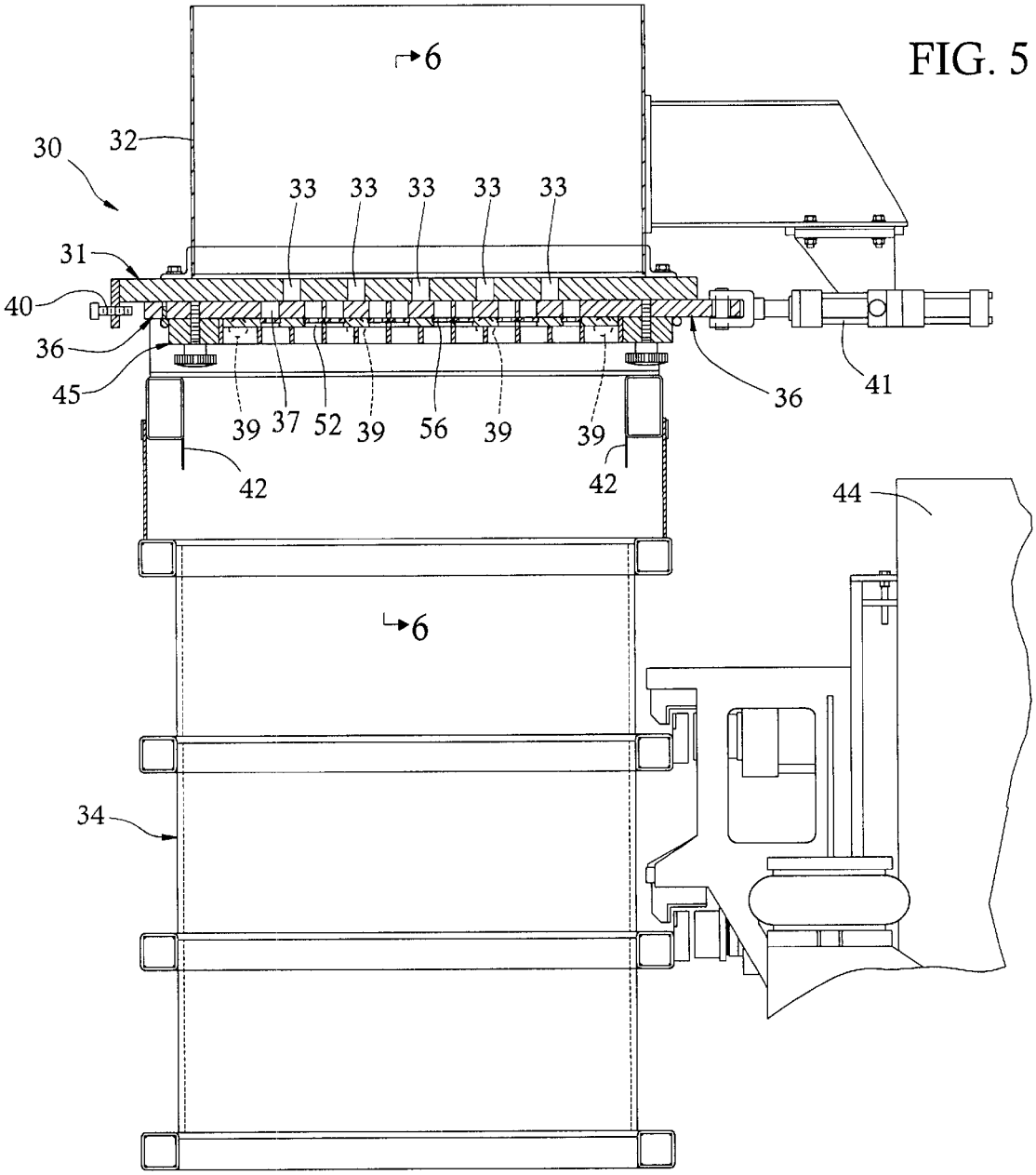
FIG. 5 is a side elevational view of a sand filling station in a foundry operation illustrating features of the present invention.
Figure 6:
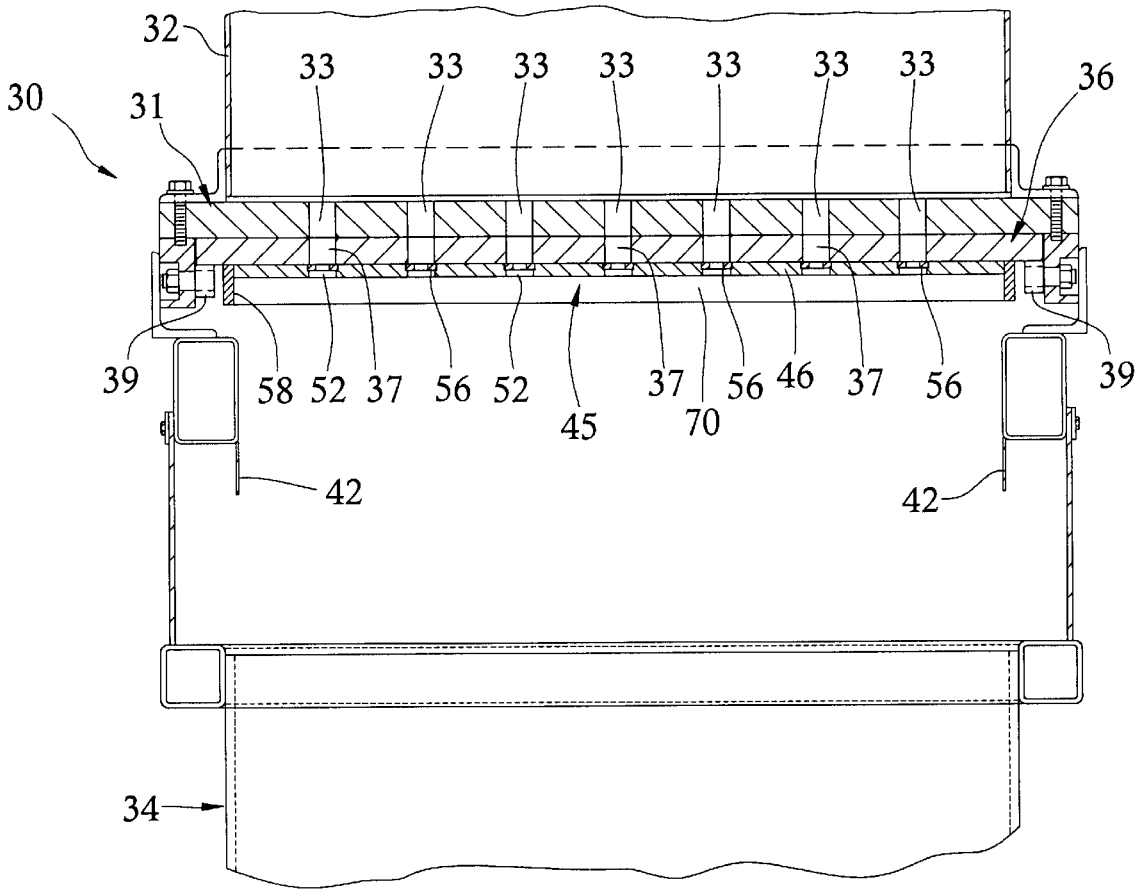
FIG. 6 is sectional view taken along line 6—6 of FIG. 5.
Figure 7A:
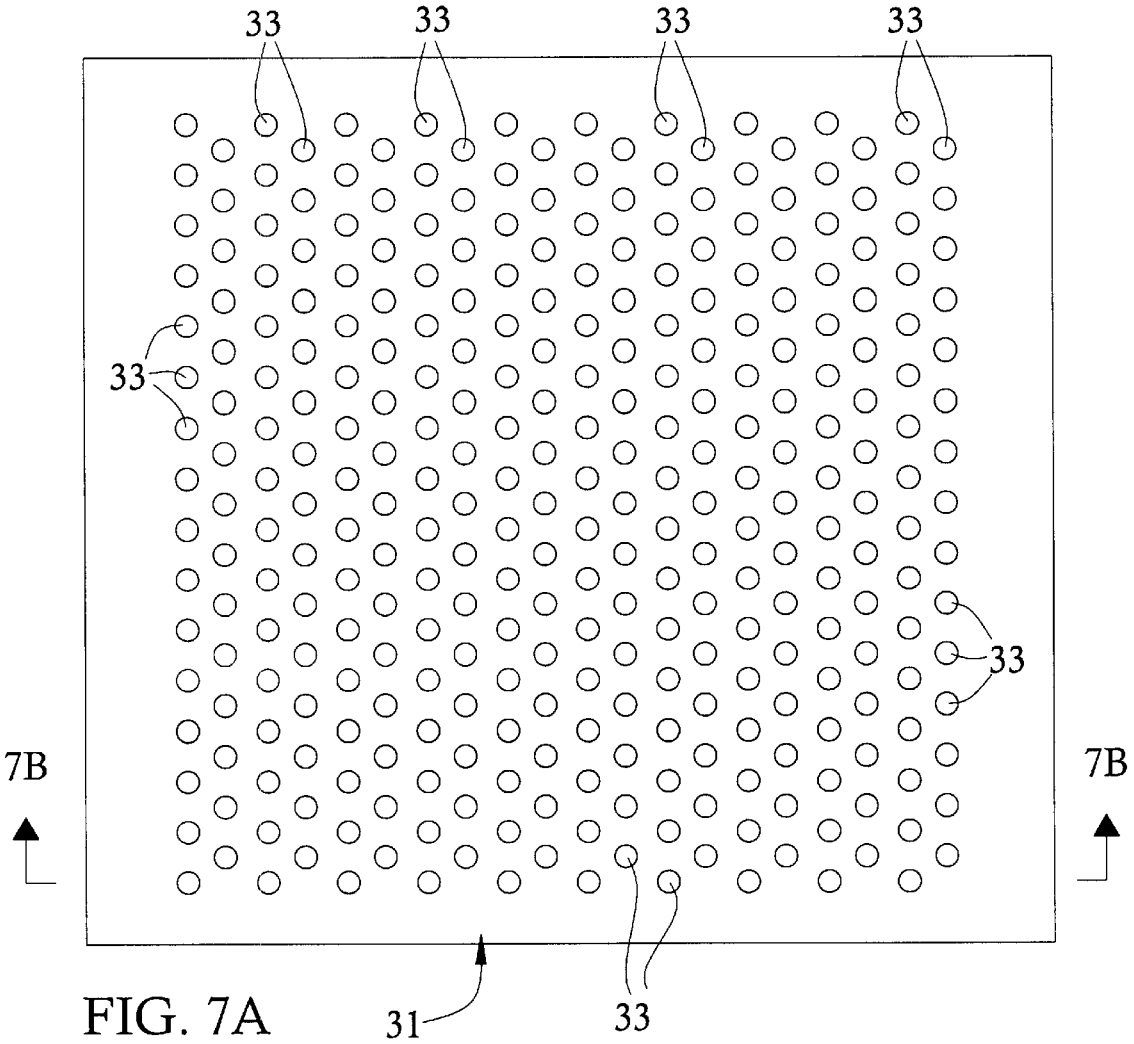
FIG. 7A is a plan view of a proximal distribution plate.
Figure 7B:
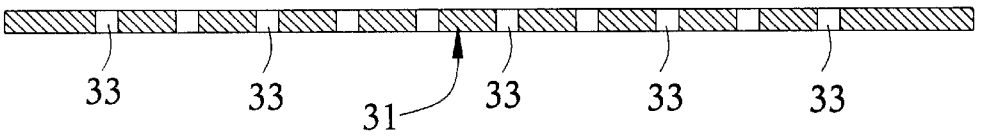
FIG. 7B is a sectional view of the proximal distribution plate as illustrated in FIG. 7A taken along line 7B—7B.
Figure 8A:
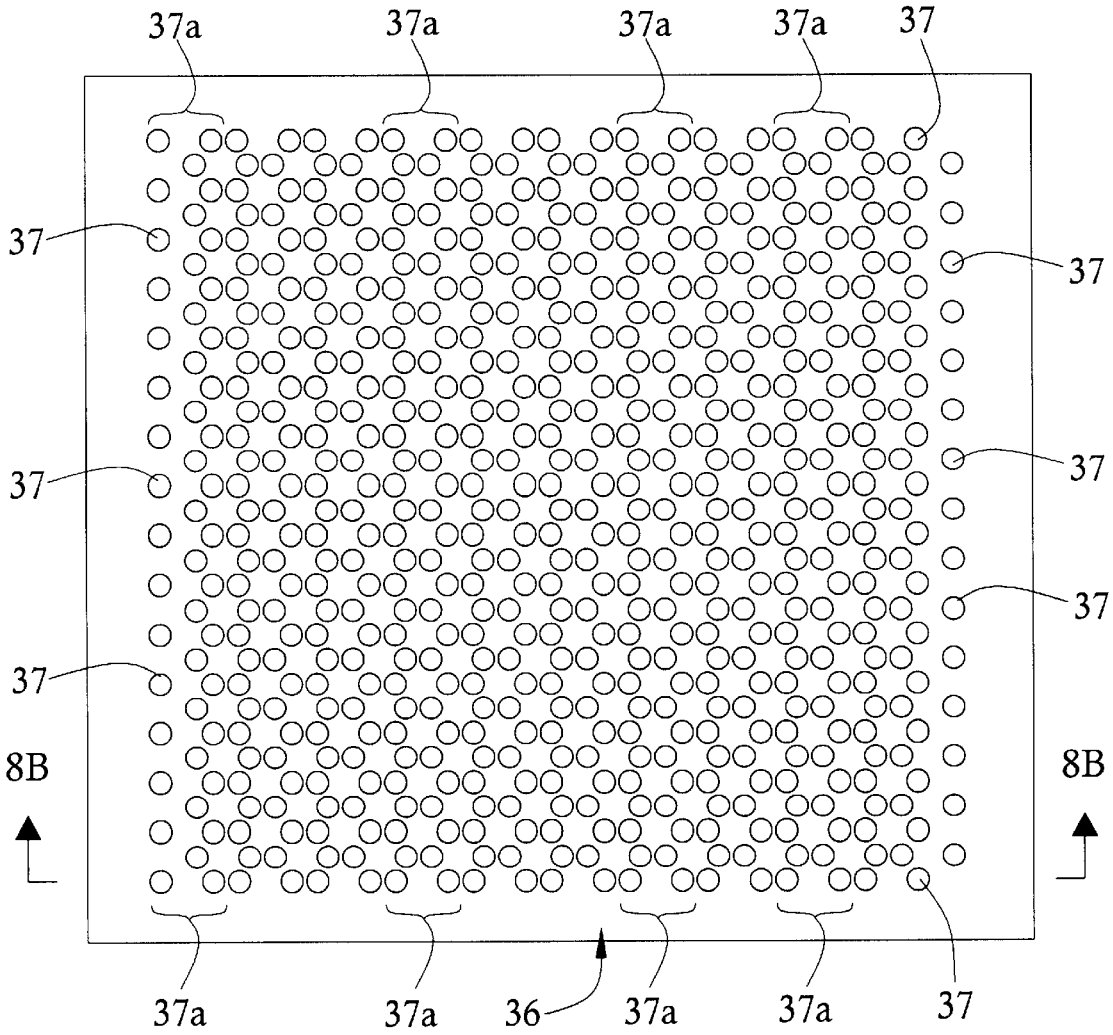
FIG. 8A is a plan view of a distal distribution plate of the present invention.
Figure 8B:
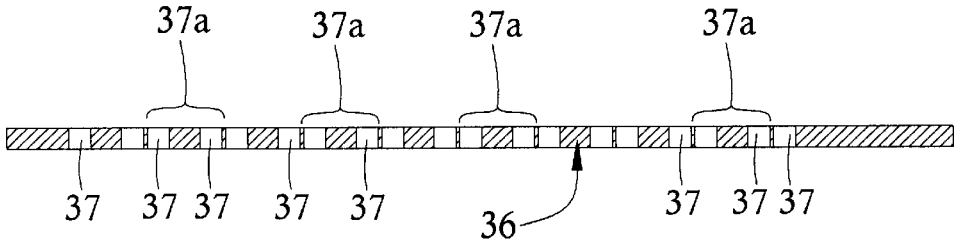
FIG. 8B is a sectional view of the distal distribution plate of the present invention as illustrated in FIG. 8A taken along line 8B—8B.
Figure 9A:
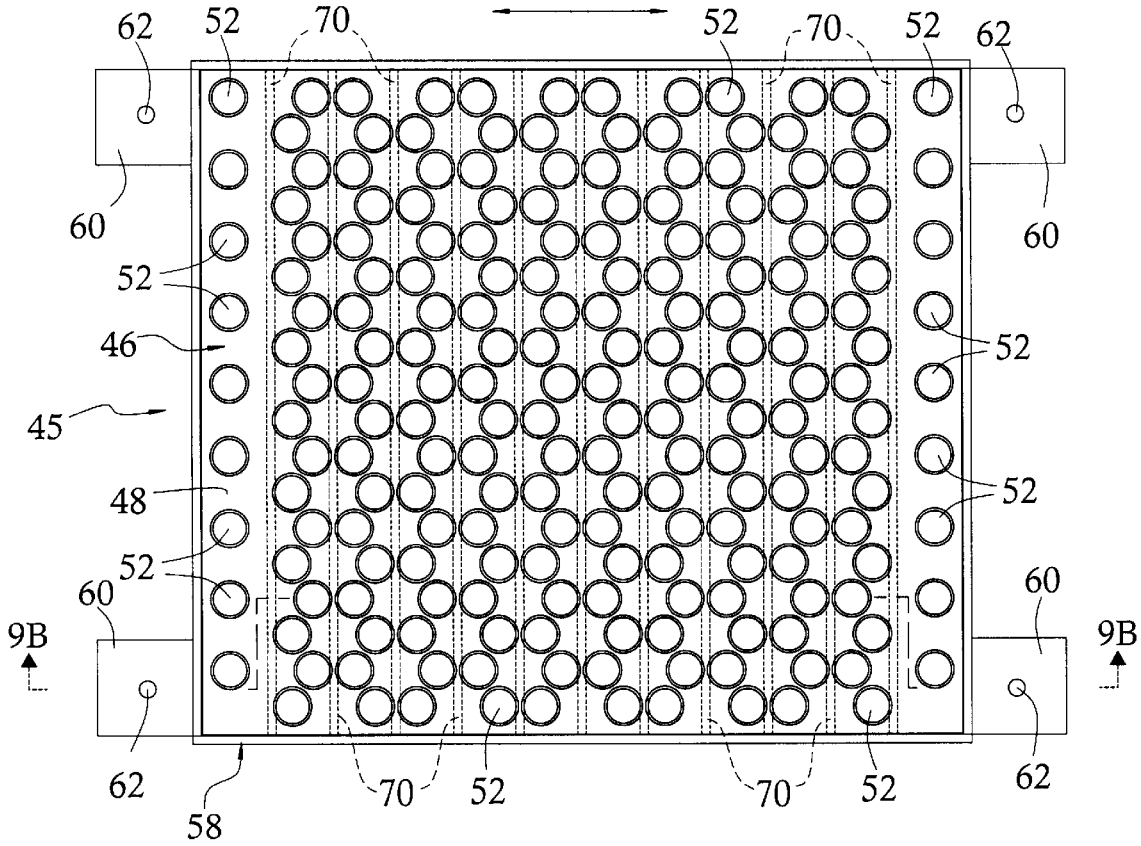
FIG. 9A is a plan view of a masking plate assembly of the present invention.
Figure 9B:
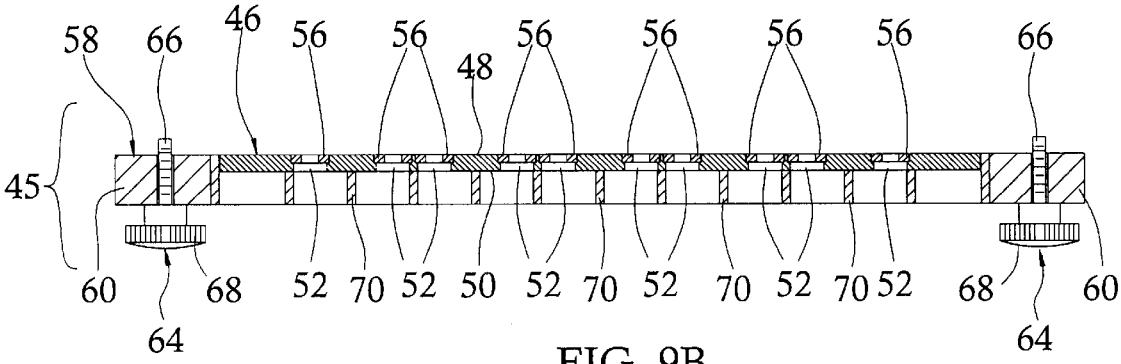
FIG. 9B is a sectional view of the masking plate assembly of the present invention as illustrated in FIG. 9A taken along line 9B—9B.

The present invention, therefore, is an improved sand distribution apparatus 30 that is useful to overcome the problems and shortcomings in the prior art described above. The preferred embodiment of the sand distribution apparatus 30 is illustrated in FIGS. 5–13. Referring to FIGS. 5 and 6, this sand distribution apparatus 30 comprises a proximal distribution plate 31, or "fixed plate", mounted subjacent a hopper 32, wherein the proximal distribution plate 31 has a plurality of uniform primary apertures 33 therethrough, through which sand flows from the hopper 32 into a mold flask 34. The sand distribution apparatus 30 additionally includes a distal distribution plate 36, or "slide plate", slidably mounted subjacent the proximal distribution plate 31, wherein the distal distribution plate 36 has a series 37A of secondary apertures 37 therethrough, with each series 37A of secondary apertures 37 corresponding to one aperture 33 through the proximal distribution plate 31 (see FIGS. 10A and 10B). Each series 37A of secondary apertures 37 includes at least one secondary aperture 37, but preferably includes two secondary apertures 37. When each series 37A includes a plurality of secondary apertures 37, the user has the option to choose either of the secondary apertures 37, with each secondary aperture 37 corresponding to the desired flow rate of the sand. The organization of the primary apertures 33 in conjunction with each series 37A of secondary apertures 37 is such that the distal distribution plate 36 is movable between a closed position, wherein the primary apertures 33 do not overlap the secondary apertures 37 (see FIG. 10A), and a plurality of open positions, wherein the centerline of each primary aperture 33 exactly overlaps one the centerline of one secondary aperture 37 of the series 37A of secondary apertures 37 (see FIGS. 11A–12B).

Looking back to FIGS. 5 and 6, the sand distribution apparatus 30 additionally includes a masking plate assembly 45 that is attached subjacent said to the distal distribution plate 36. The masking plate assembly 45, as clearly illustrated in FIG. 10B, includes a masking plate 46 having a first upper surface 48 and a second lower surface 50, with a series of masking plate bores 52 extending from the first upper surface 48 to the second lower surface 50. Looking to FIGS. 13A and 13B, each masking plate bore 52 of the masking plate 46 corresponds with one secondary aperture 37 traversing through the distal distribution plate 36. Each masking plate bore 52 has a principal diameter D1 that extends completely through the masking plate 46 through which the sand traverses. In this first embodiment, the principal diameter D1 is preferably of the width desired to govern the rate of flow of sand through the masking plate 46.

Figures 10A, 10B:
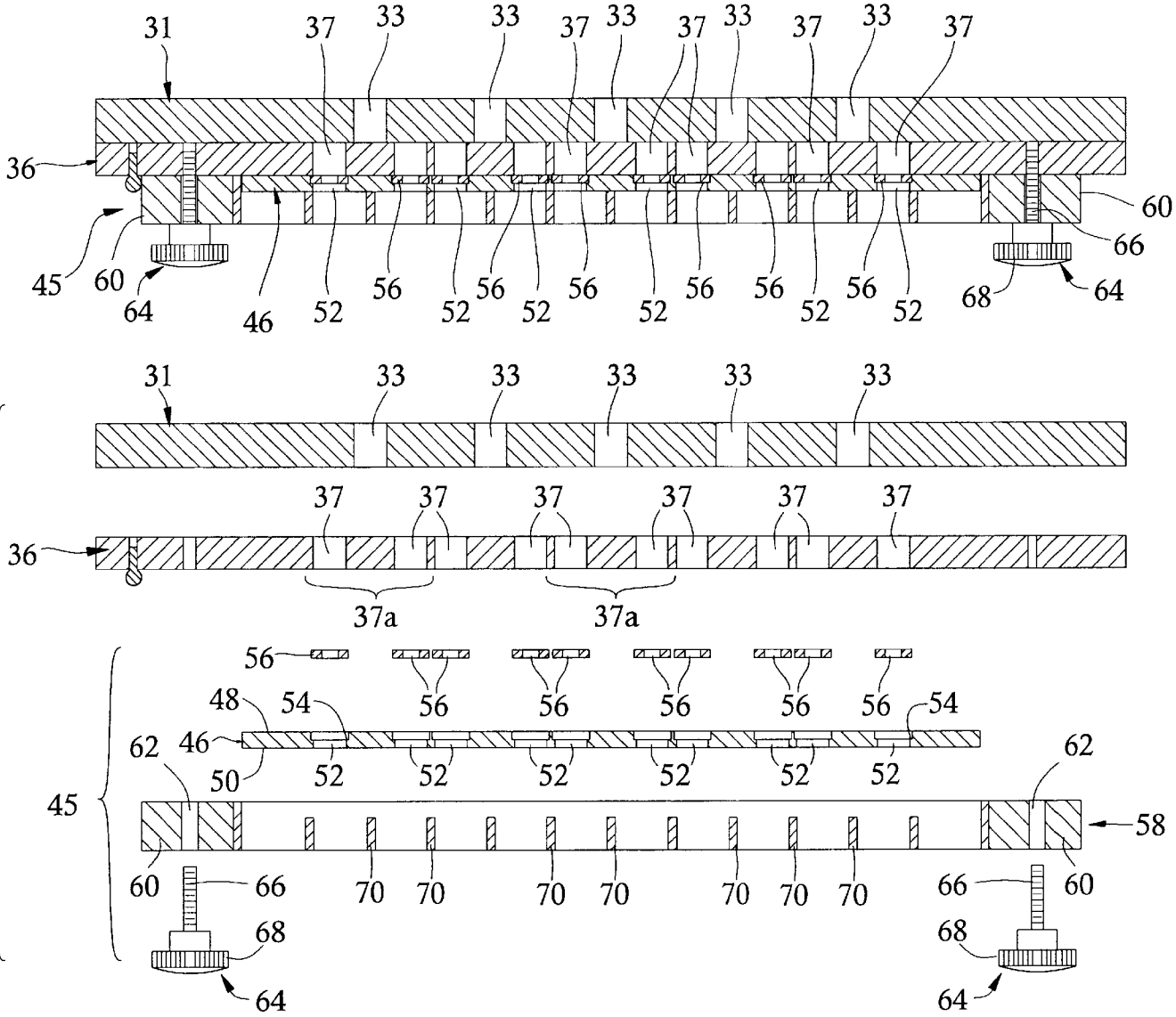
FIG. 10A is a sectional view of the proximal and distal distribution plates and masking plate assembly of the present invention in a closed position.
FIG. 10B is an exploded view of the sectional view of the proximal and distal distribution plates and the masking plate assembly of the present invention as illustrated in FIG. 10A.

Continuing to refer to FIGS. 10B and 13B, a second embodiment of each masking plate bore 52 further includes an auxiliary diameter D2 extending down from the first upper surface 48 of the masking plate 46 partially through the masking plate 46 toward the lower surface 50 of the masking plate 46. In such an embodiment, the auxiliary diameter D2 is greater than the principal diameter D1 such that a shoulder 54 is created within each masking plate bore 52. The shoulder 54 is thereby able to receive a ring member 56 (or plug) that is included in this embodiment. The ring member 56 includes an inner diameter D3 and an outer diameter D4. The outer diameter D4 of each ring member 56 is designed such that the ring member 56 will fit onto the shoulder 54 within the masking plate bore 52. Preferably, once the ring member 56 is positioned within the masking plate bore 52, the first upper surface 48 of the masking plate 46 and the upper surface of the ring member 56 will be flush to provide a smooth surface.

In contrast to the first embodiment, the inner diameter D3 of each ring member 56 of this embodiment defines the rate of flow of sand through the ring member 56 and the corresponding masking plate bore 52 rather than the principal diameter D1 of the masking plate bore 52. For example, the larger the inner diameter D3 of the ring member 56, the more sand that will be able to traverse the masking plate bore 52, whereas the smaller the inner diameter D3 of the ring member 56, the less sand that will be able to traverse the masking plate bore 52. Furthermore, while the desired shape of each ring member 56 is preferably circular, other shaped ring members, such as elliptical members, may be used in place of the circular shaped members as desired by the user.

Looking at FIGS. 9A–10B, the masking plate assembly 45 additionally includes a masking plate holder 58 that is used to position the masking plate 46 in abutment with the distal distribution plate 36. In the preferred embodiment, the masking plate holder 58 is connected to the distal distribution plate 36 using a series of flanges 60 attached to the edge of the masking plate holder 58. Each flange 60 includes a connecting hole 62 to receive a locking member 64 preferably having a shaft 66 and a handle 68. The shaft 66 is able to traverse the connecting hole 62 to engage the distal distribution plate 36. It is to be noted that this is one embodiment among many that may be implemented to position the masking plate 46 in a proximate relationship with the distal distribution plate 36. The masking plate holder 58 additionally includes a series of reinforcement braces 70 spaced such that sand may flow between each brace 70.

As stated above, each series 37A of secondary apertures 37 preferably includes two apertures 37, with each secondary aperture 37 of the series 37A corresponding to a masking plate bore 52 (see FIGS. 10A–10B). Hence, each individual primary aperture 33 preferably corresponds with two masking plate bores 52. As a result, in the first embodiment, the principal diameter D1 of each masking plate bore 52 determines the rate of flow of sand through the masking plate 46. Each masking plate bore 52 may have a principal diameter D1 different from the other masking plate bores 52 so as to provide 15 multiple flow rates of sand through the primary aperture 33 depending on which masking plate bore 52 is aligned with the primary aperture 33. Accordingly, as different flow rates are desired by the user through the proximal and distal distribution plates 31, 36, the appropriate masking plate bores 52 having the desired principal diameter D1 are fully aligned with the primary apertures 33 to provide for varying rates of sand flow without having to partially overlap the apertures through the distribution plates 31, 36, thereby eliminating skewed and offset sand flow.

Similarly, in the second embodiment, each secondary aperture 37 of the series 37A corresponds to a masking plate bore 52, and the masking plate bores 52 corresponding with the series 37A of secondary apertures 37 have two independent ring members 56. As a result, each independent ring member 56 within the series 37A may have an inner diameter D3 different from the other ring members 56 so as to provide multiple rates of flow of sand through the primary aperture 33 depending on which masking plate bore 52 and ring member 56 is aligned with the primary aperture 33. Accordingly, as different flow rates are desired by the user through the proximal and distal distribution plates 31, 36, the appropriate ring members 56 having the desired inner diameter D3 are fully aligned with the primary apertures 33 to provide for varying rates of sand flow without having to partially overlap the apertures through the distribution plates 31, 36, thereby eliminating skewed and offset sand flow.

Furthermore, this usage of ring members 56 provides the additional benefit of easily manipulating and controlling the flow of sand at different flow rates throughout the masking plate 46. For example, due to the structure of some foam patterns 14, the rate of sand flow into the flask 34 may be desired to be greater at a first side than at a second side. In such a situation, the ring members 56 placed toward the first side could have greater inner diameters D3, while the ring members 56 placed toward the second side could have smaller inner diameters D3 such that the flow rate of the sand will be greater at the first side than at the second side. As a result, multiple sand flow patterns may be created as desired by the user through the use of the various ring members 56, as opposed to prior methods wherein an entirely new distal distribution plate 36 had to be assembled and placed in abutment with the proximal distribution plate 31 to provide a pattern for desired sand flow. Therefore, an additional advantage to this design is that the masking plate assembly 45 may easily be disassembled from the distal distribution plate 36 so that the ring members 56 having various inner diameters D3 may easily be exchanged to control the pattern of distribution of sand into the mold flask 34 as the user desires.

Referring to FIGS. 5 and 6, the distal distribution plate 36 is preferably supported on a series of rollers 39 which maintain the proximal and distal distribution plates 31, 36 in abutment with one another to resist sand from penetrating therebetween. If any sand does penetrate between the proximal and distal distribution plates 31, 36, that sand will migrate to the edge of the proximal and distal distribution plates 31, 36 and will fall into the flask 34 rather than accumulate between the distal distribution plate 36 and the support therefor, as seen with the prior art L-bracket 22 (see FIG. 2). Further, the rollers 39 allow the distal distribution plate 36 to be moved between positions with less load required than that available from the prior art L-bracket 22 (see FIG. 2). Additionally, the rollers 39 are preferably vertically adjustable to maintain the distal distribution plate 36 in abutment with the proximal distribution plate 31, and thereby limit the amount of sand moving between the distal distribution plate 36 and the proximal distribution plate 31.

The sand filling station includes urging means 41, such as a double acting hydraulic cylinder, for precisely positioning the distal distribution plate 36 longitudinally between the closed position, illustrated in FIG. 5, and the various open positions, illustrated in FIGS. 11A–12B. Moreover, one or more positive stop locators 40 may be attached to one end of the proximal distribution plate 31 (see FIG. 5). The positive stop locators 40 are positioned to ensure the positive location of the distal distribution plate 36 at open positions with respect to the proximal distribution plate 31. The sand filling station also preferably includes guide means 42 for guiding sand from the periphery of the distribution plates 31, 36 into the flask 34 and a dust shield 43 to prevent sand fines from escaping into the surrounding environment. Additionally, a vibrating means 44 may be included to oscillate the flask 34 during the sand filling process to promote proper distribution and compaction of the sand about the mold pattern and into any cavities or crevices therein.

It is to be understood that the form of the IMPROVED SAND GATE FOR USE IN A SAND DISTRIBUTION APPARATUS described is a preferred embodiment thereof and that various changes and modifications may be made therein without departing from the spirit of the invention or scope as defined in the following claims.

What is claimed is:

1. An apparatus for distributing a granular material from a hopper into a mold flask in a foundry process, comprising:

a proximal distribution plate affixed to a lower portion of the hopper, wherein said proximal distribution plate includes a plurality of uniform primary apertures therethrough;

a distal distribution plate slidably mounted in abutment with said proximal distribution plate, wherein said distal distribution plate includes a series of secondary apertures therethrough;

a masking plate mounted to said distal distribution plate, said masking plate including a first surface and a second surface with a series of masking plate bores traversing said masking plate, said masking plate being mounted to said distal distribution plate such that said masking plate bores are in line with said secondary apertures, said masking plate bores having a principal diameter therethrough to determine the flow rate of the granular material through said masking plate into the flask; and wherein each said primary aperture corresponds to at least one secondary aperture and masking plate bore such that said distal distribution plate is movable between a closed position, wherein said primary apertures do not overlap said secondary apertures and masking plate bores, and an open position, wherein said primary apertures overlap said secondary apertures and said masking plate bores such that granular material flows from the hopper through said primary apertures, said secondary apertures, and said masking plate bores.

2. The apparatus as described in claim 1, wherein each said primary aperture corresponds with a first and second secondary aperture and a first and second masking plate bore such that said distal distribution plate is selectively movable between a closed position, wherein each said primary aperture does not overlap either said first or second secondary aperture, and a selected one of a plurality of open positions, wherein each said primary aperture overlaps either said first or second secondary apertures such that the granular material flows from the hopper into the mold flask through said overlapping primary and secondary apertures and said masking plate bores.

3. The apparatus as described in claim 1 further comprising a series of ring members having an inner diameter and an outer diameter;

wherein said masking plate bores further include an auxiliary diameter subjacent said first surface of said masking plate, said auxiliary diameter being greater than said principal diameter to create a shoulder within said masking plate bore;

wherein said outer diameter being slightly less than said auxiliary diameter of said masking plate bore such that said ring member will rest on said shoulder of said masking plate bore; and wherein said inner diameter of said ring member determines the flow rate of the granular material through said masking plate into the flask.

4. The apparatus as described in claim 3, wherein said inner diameter of said ring member is less than the diameter of said secondary aperture to limit the flow of the granular material through said distal distribution plate and said masking plate.

5. The apparatus as described in claim 3, wherein each said primary aperture corresponds with a first and second secondary aperture and a first and second masking plate bore with a first and second ring member, such that said distal distribution plate is selectively movable between a closed position, wherein each said primary aperture does not overlap either said first or second secondary aperture, and a selected one of a plurality of open positions, wherein each said primary aperture overlaps either said first or second secondary apertures such that the granular material flows from the hopper into the mold flask through said overlapping primary, secondary, and masking plate bores.

6. The apparatus as described in claim 5, where in said inner diameter of said first ring member is greater than said inner diameter of said second ring member.

7. The apparatus as described in claim 3, wherein said inner diameter of each said ring member is substantially equal to the diameter of said primary apertures.

8. The apparatus as described in claim 1 further comprising urging means operatively connected to said distal distribution plate for moving said distal distribution plate between said closed position and said open position.

9. The apparatus as described in claim 8 wherein said urging means comprises a double acting hydraulic cylinder.

10. The apparatus as described in claim 1 further comprising means for supporting said distal distribution plate, wherein said supporting means maintains said proximal and distal distribution plates in abutment.

11. The apparatus as described in claim 10, wherein said supporting means comprises at least two rollers mounted subjacent each of two opposing sides of said distal distribution plate.

12. The apparatus as described in claim 11, wherein said rollers are vertically adjustable.

13. The apparatus as described in claim 1 further comprising a positive stop locator attached to said proximal distribution plate, said distal distribution plate engaging said positive stop locator at said open position.

14. An apparatus for distributing sand from a hopper into a mold flask in a foundry process, comprising:

a proximal distribution plate affixed to a lower portion of the hopper, wherein said proximal distribution plate has a plurality of primary apertures therethrough;

a distal distribution plate slidably mounted subjacent said proximal distribution plate and in abutment therewith, wherein said distal distribution plate has a plurality of pairs of secondary apertures therethrough; and a masking plate mounted to said distal distribution plate, wherein said masking plate has a plurality of pairs of masking plate bores corresponding to each said pair of secondary apertures, wherein each masking plate bore has a principal diameter traversing said masking plate;

wherein each pair of said secondary apertures and masking plate bores corresponds to one of said primary apertures such that said distal distribution plate is movable between a closed position, wherein said primary apertures do not overlap said secondary and masking plate bores, and infinitely variable open positions, wherein said primary apertures overlap one secondary aperture and masking plate bore of said pair of secondary apertures and masking plate bores, wherein sand flows from the hopper into the mold flask through said overlapping primary and secondary apertures.

15. The apparatus as described in claim 14 wherein said masking plate bore further includes an auxiliary diameter subjacent a first surface of said masking plate, said auxiliary diameter being greater than said principal diameter to form a shoulder within said masking plate bore; and further comprising a series of ring members having an inner and an outer diameter, the outer diameter of each said ring member being such that each said ring member will fit onto said shoulder within any said masking plate bore such that said inner diameter controls the rate of flow of sand through said masking plate bore.

16. The apparatus as described in claim 15, wherein each said ring member is placed in one said masking plate bore to control the rate of flow of sand through said masking plate bore according to the length of said inner diameter of said ring member.

17. The apparatus as described in claim 15 further comprising urging means operatively connected to said distal distribution plate for moving said distal distribution plate between said closed and open positions.

18. The apparatus as described in claim 17 wherein said urging means comprises a double acting hydraulic cylinder.

19. The apparatus as described in claim 14 further comprising means for supporting said distal distribution plate, wherein said supporting means comprises at least two rollers mounted subjacent each of two opposing sides of said distal distribution plate.

20. The apparatus as described in claim 19, wherein said rollers are vertically adjustable.

21. The apparatus as described in claim 14 further comprising a positive stop locator attached to said proximal distribution plate, said distal distribution plate engaging said positive stop locator at said open position.

22. A method for distributing a granular material from a hopper into a mold flask in a foundry process comprising:

a. providing a proximal distribution plate affixed to a lower portion of the hopper, wherein said proximal distribution plate includes a plurality of uniform primary apertures therethrough;

b. providing a distal distribution plate in abutment with said proximal distribution plate, wherein said distal distribution plate includes a series of secondary apertures therethrough;

c. providing a masking plate having a series of masking plate bores, each masking plate bore having a principal diameter extending through said masking plate;

d. attaching said masking plate to said distal distribution plate such that said masking plate bores are in alignment with said secondary apertures; and e. selectively moving said distal distribution plate such that said primary apertures will overlap said secondary apertures and said masking plate bores to allow sand to flow through said secondary apertures and said masking plate bores.

23. The method as described in claim 22 wherein step c further includes providing an auxiliary diameter within each said masking plate bore such that said auxiliary diameter is subjacent a top surface of said masking plate to create a shoulder; and placing one ring member of a plurality of ring members onto each shoulder of each masking plate bore of said masking plate, each ring member having an inner diameter and an outer diameter.

24. The method as described in claim 23 wherein step c further includes placing ring members having inner diameters of various sizes onto said shoulders of said masking plate bores.

25. An improved apparatus for distributing a granular material from a hopper into a mold flask through a sand gate of the type in which the sand gate includes a fixed distribution plate with a series of primary apertures and a movable distribution plate with a series of secondary apertures in abutment with the fixed distribution plate, and in which the movable distribution plate is urged from a closed position in which the primary apertures do not overlap the secondary apertures to an open position in which the primary apertures do overlap the secondary apertures to allow sand to flow therethrough, wherein the improvement comprises:

a masking plate having a first surface and a second surface with a series of masking plate bores traversing said masking plate, wherein said masking plate bores include a principal diameter extending through said masking plate;

wherein said masking plate is mounted to the movable distribution plate such that said masking plate bores are in alignment with the secondary apertures; and wherein said principal diameter of said plate bore determines the flow of sand through said masking plate.

26. The improved apparatus as described in claim 25 further comprising a series of ring members having an inner diameter and an outer diameter;

wherein said masking plate bore further includes an auxiliary diameter extending subjacent said first surface, said auxiliary diameter being greater than said principal diameter to form a shoulder within said masking plate bore; and wherein said outer diameter of said ring member being slightly less than said auxiliary diameter of said masking plate bore such that said ring member will rest on said shoulder of said masking plate bore;

wherein said inner diameter of said ring member determines the flow of sand through said masking plate bores.

* * * * *